US009562349B2

(12) United States Patent
McLeod

(10) Patent No.: US 9,562,349 B2
(45) Date of Patent: Feb. 7, 2017

(54) REMOVABLE TRAP FOR LAVATORY SINKS

(71) Applicant: Christopher Adam McLeod, Toronto (CA)

(72) Inventor: Christopher Adam McLeod, Toronto (CA)

( * ) Notice: Subject to any disclaimer, the term of this patent is extended or adjusted under 35 U.S.C. 154(b) by 97 days.

(21) Appl. No.: 14/791,212

(22) Filed: Jul. 2, 2015

(65) Prior Publication Data

US 2017/0002554 A1 Jan. 5, 2017

(51) Int. Cl.
*E03C 1/12* (2006.01)
*E03C 1/284* (2006.01)

(52) U.S. Cl.
CPC ..... *E03C 1/284* (2013.01)

(58) Field of Classification Search
CPC ..... E03C 1/28; E03C 1/284
USPC ..... 4/679
See application file for complete search history.

(56) References Cited

U.S. PATENT DOCUMENTS 2,742,101 A * 4/1956 Stambaugh ..... E03C 1/284 137/247.41
4,700,412 A * 10/1987 Manuel ..... B01D 36/04 137/247.51
7,155,760 B2 * 1/2007 McAlpine ..... E03C 1/29 137/247.35
2003/0005516 A1 * 1/2003 Winzar ..... E03C 1/29 4/679
2009/0308463 A1 * 12/2009 Bacon ..... E03C 1/29 137/247

* cited by examiner

*Primary Examiner* — Huyen Le

(57) ABSTRACT

A removable trap for lavatory sinks is provided to enable new technologies to be incorporated into just the water trap portion of the sink trap to maximize the performance of the trap in infection control, while at the same time preserving the trap performance features demanded by major building codes. While a traditional P-trap requires the removal of the entire trap for cleaning or replacement, the removable trap presented in this application allows for easy removal of just the U-bend portion of the trap. The U-bend containing the water is the most vulnerable to attack to cleaning chemicals as well as the most effective locus of innovation in materials and methods employed to reduce infectious bacteria forming biofilms within the lavatory trap.

3 Claims, 10 Drawing Sheets

Isometric view of removable trap system attached to the underside of a lavatory sink fitting.

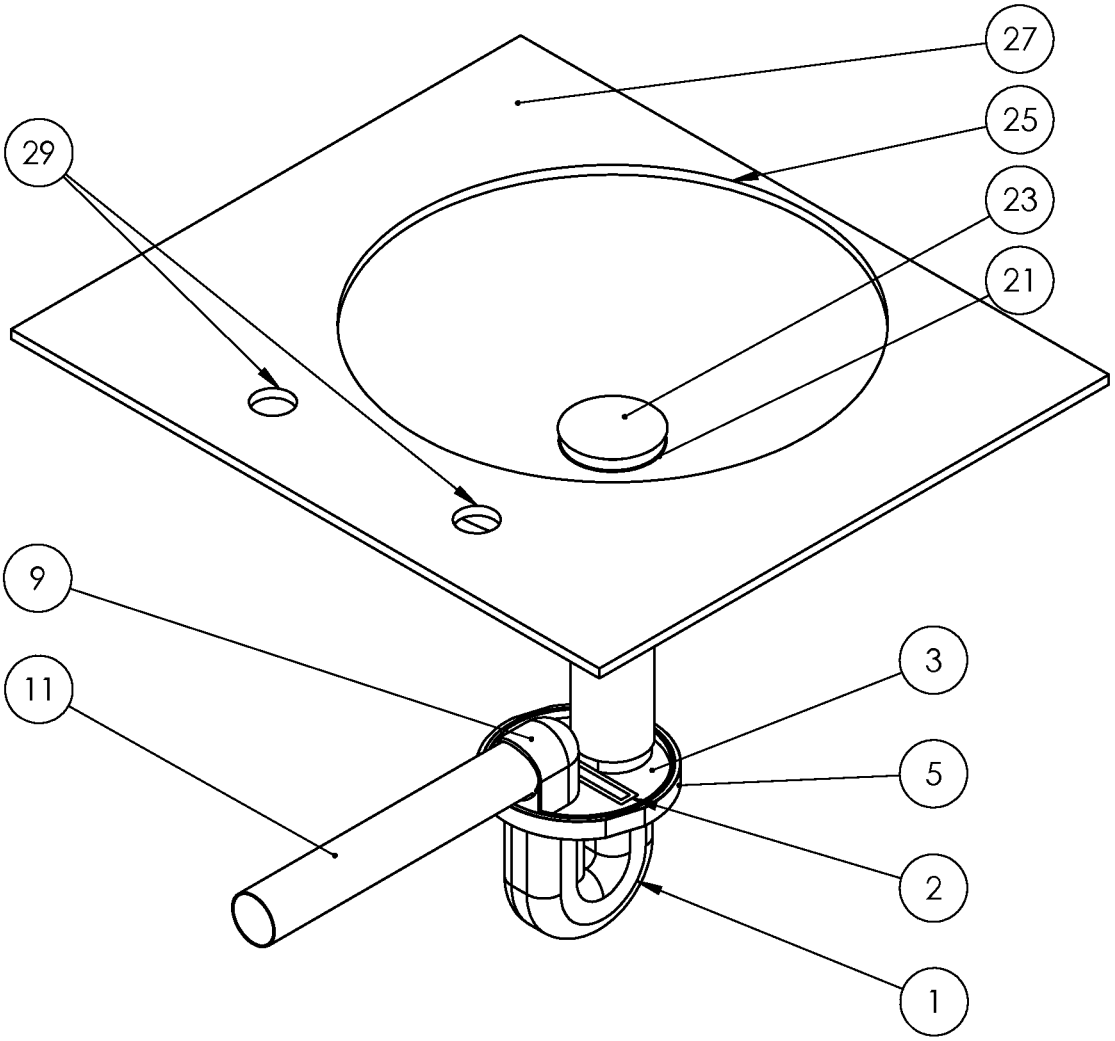
Fig. 1. Isometric view of removable trap system attached to the underside of a lavatory sink fitting.

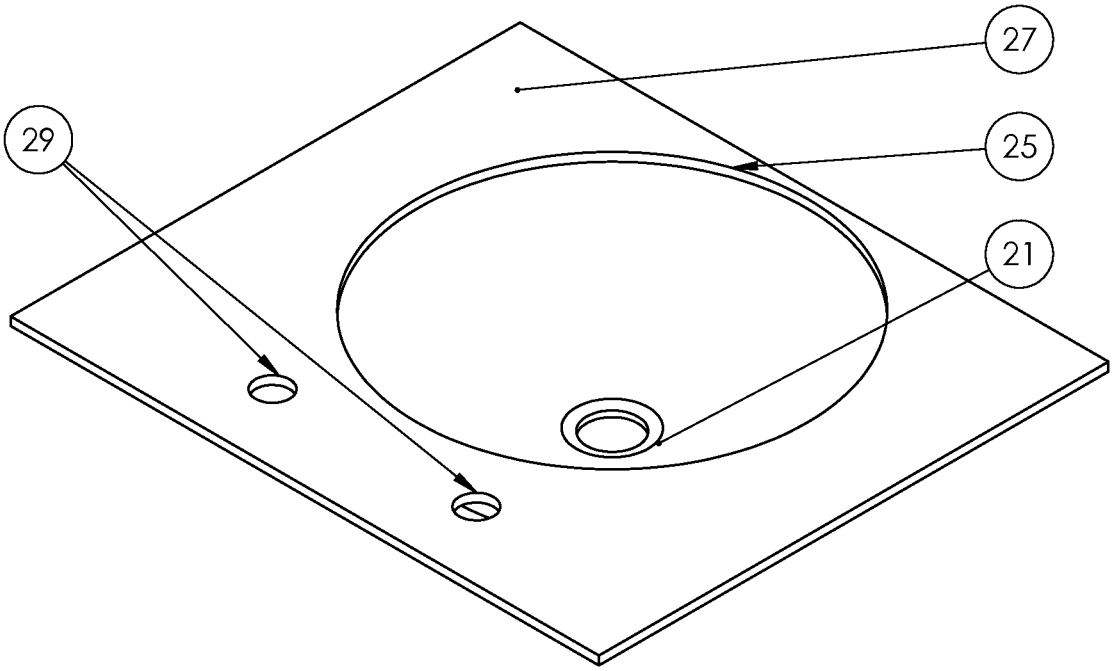
Fig. 2. Isometric view of a lavatory sink.

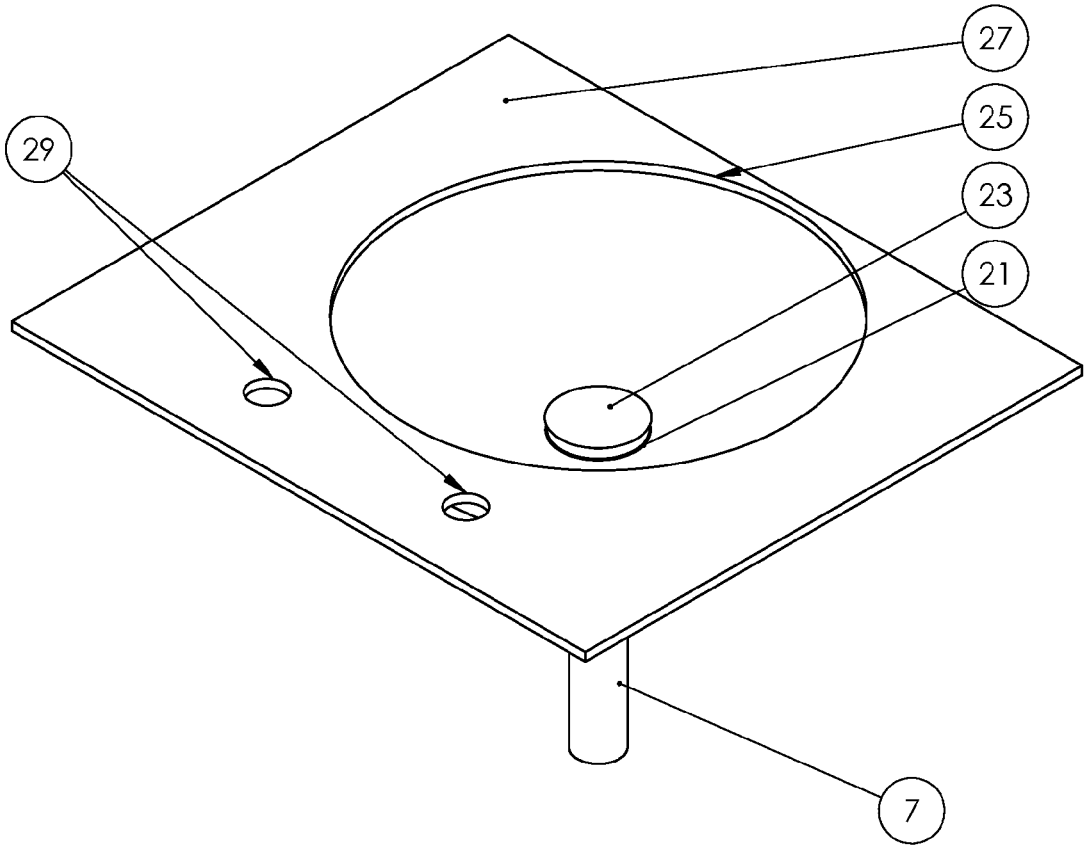
Fig. 3. Isometric view of a lavatory sink equipped with a lavatory drain fitting ending in a vertical tubular tailpiece.

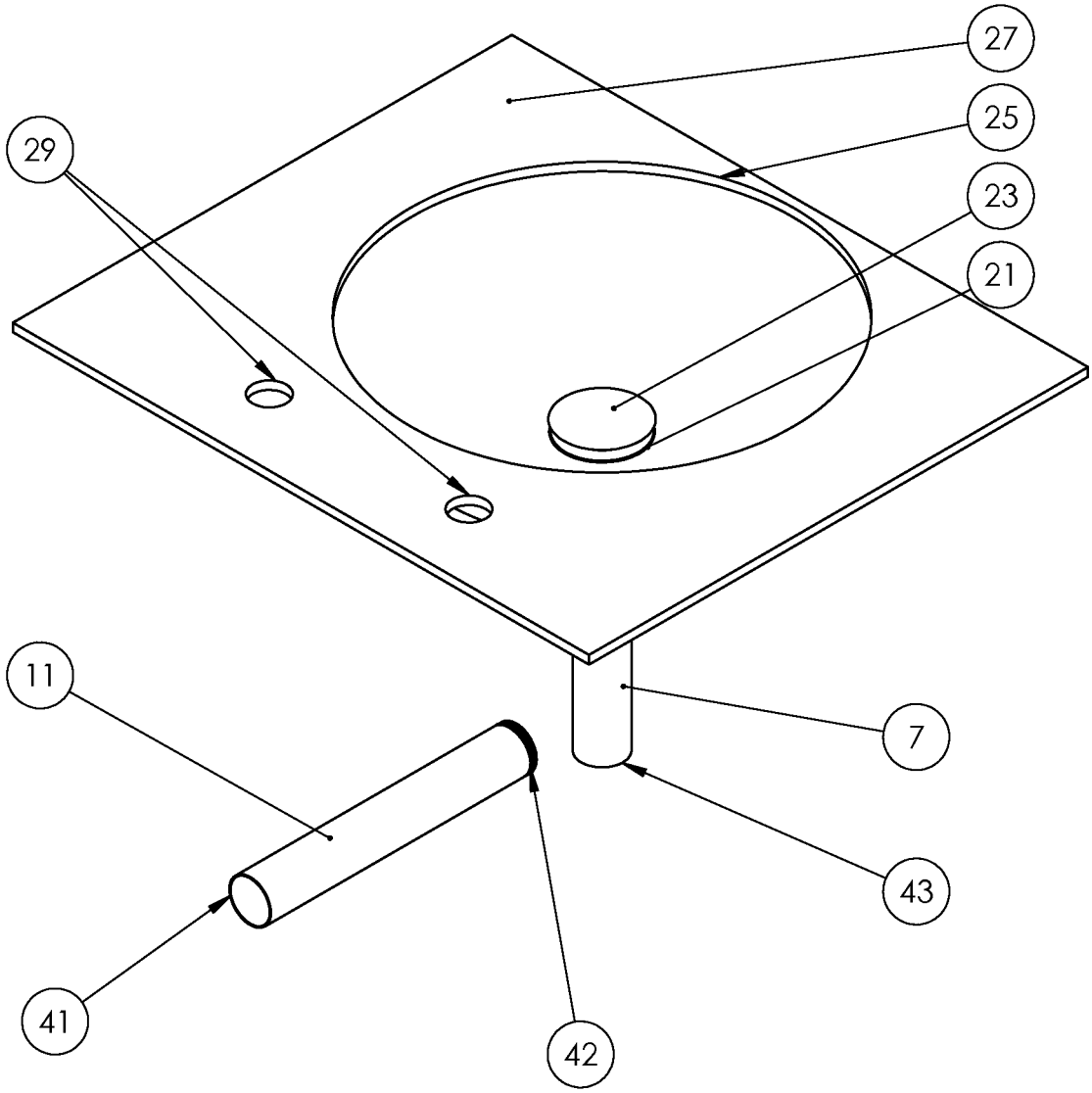
Fig. 4. Isometric view of a lavatory sink showing vertical tailpiece and disconnected horizontal waste arm.

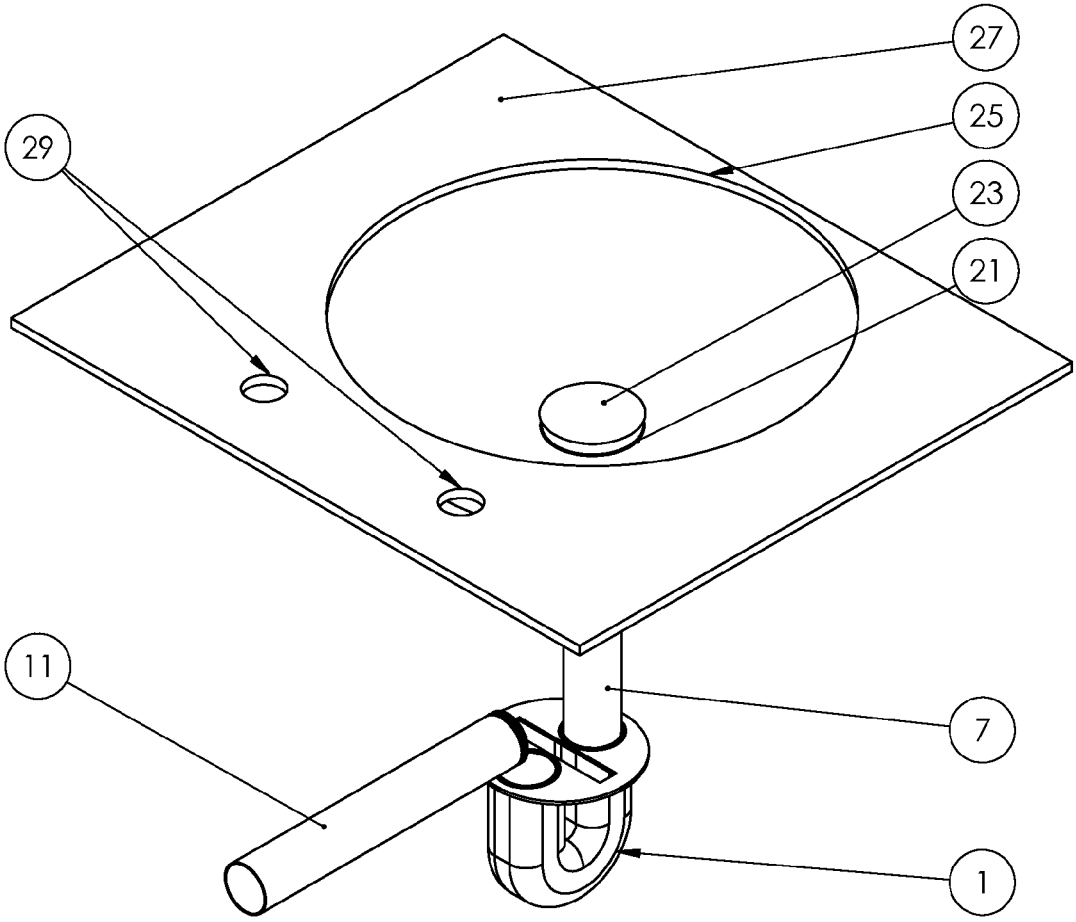
Fig. 5. Isometric view of removable trap system showing drain, tailpiece, waste arm, and tubular trap portion.

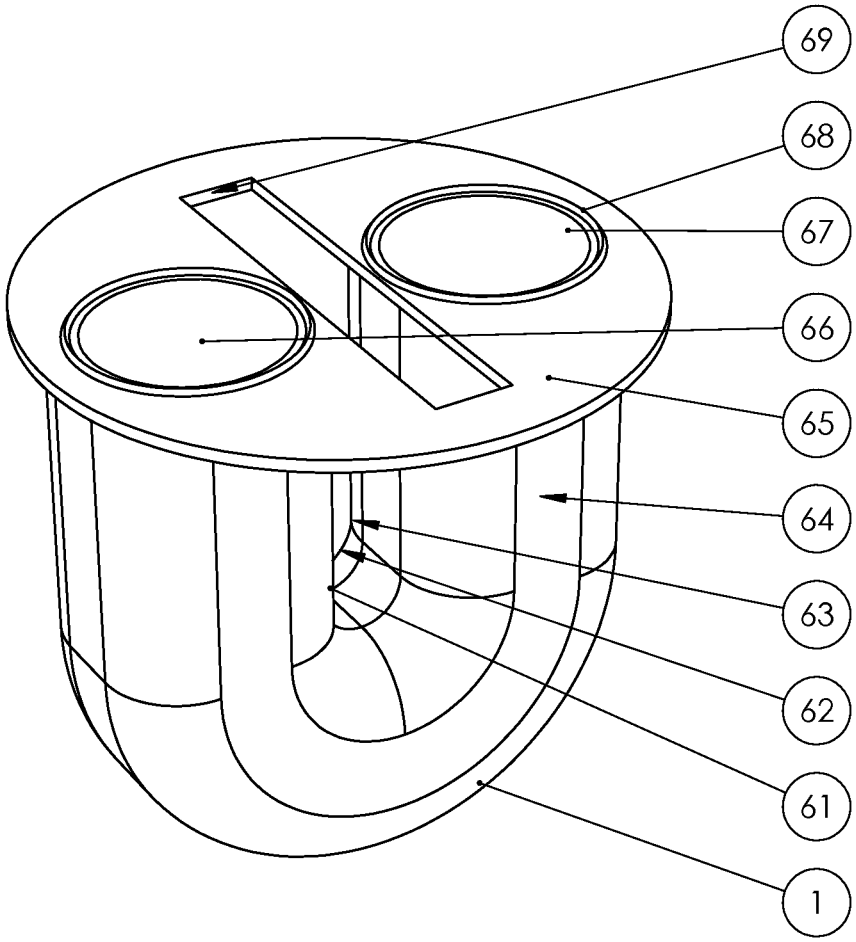
Fig. 6. Isometric view of the removable U-bend trap cartridge.

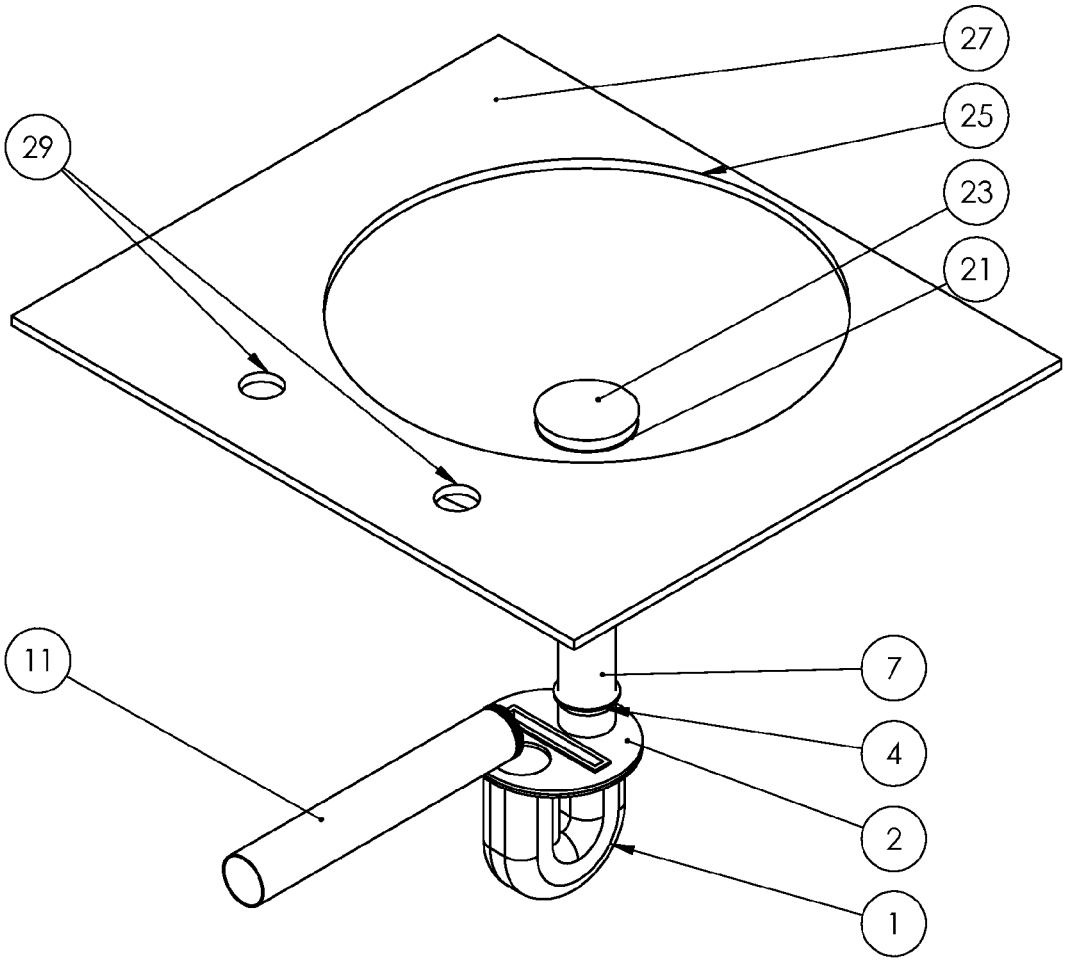
Fig. 7. Isometric view of removable trap system showing drain, tailpiece, waste arm,tubular trap, and seals.

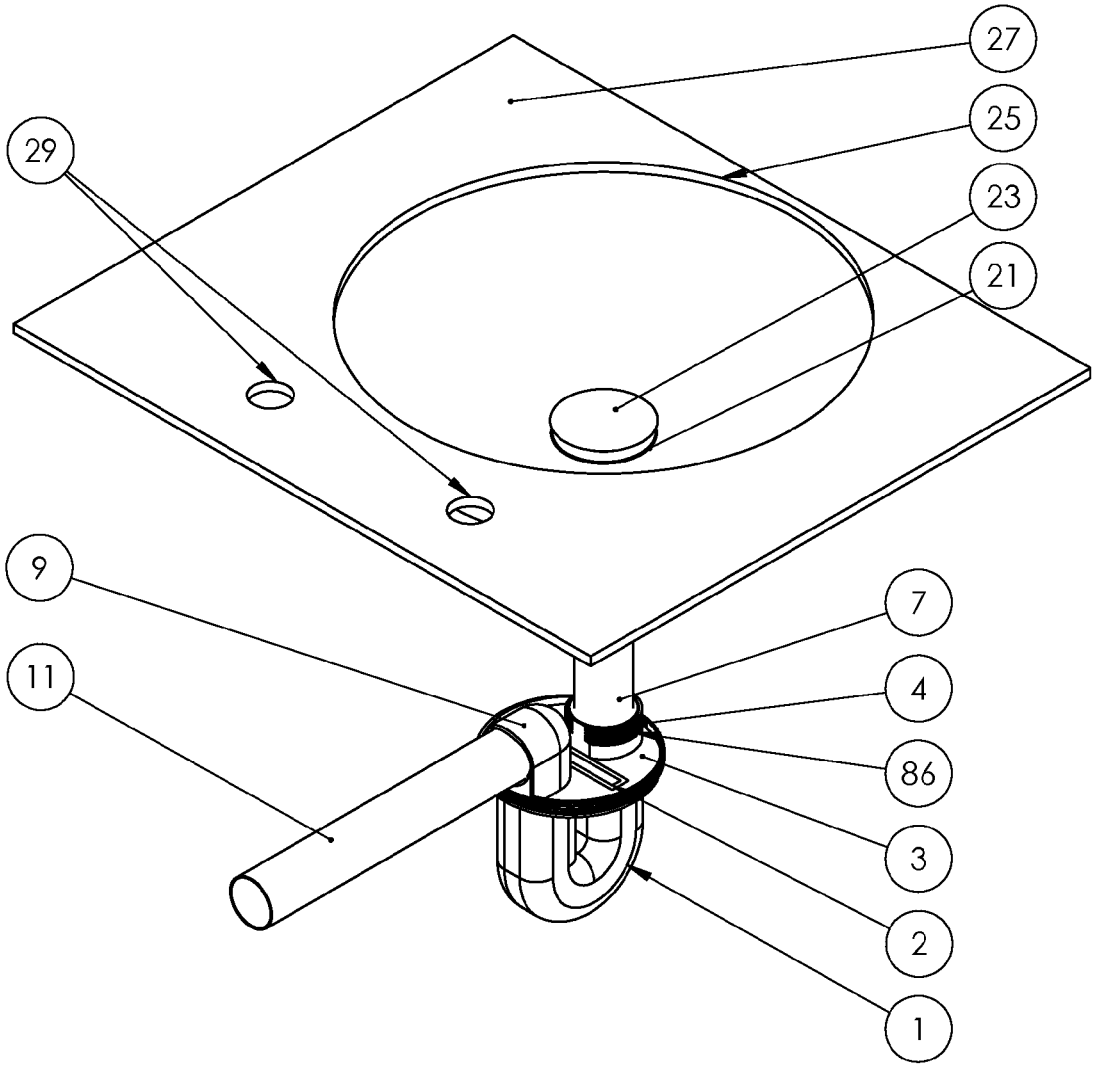
Fig. 8. Isometric view of removable trap system showing drain, tailpiece, waste arm, trap, seals, and connecting top.

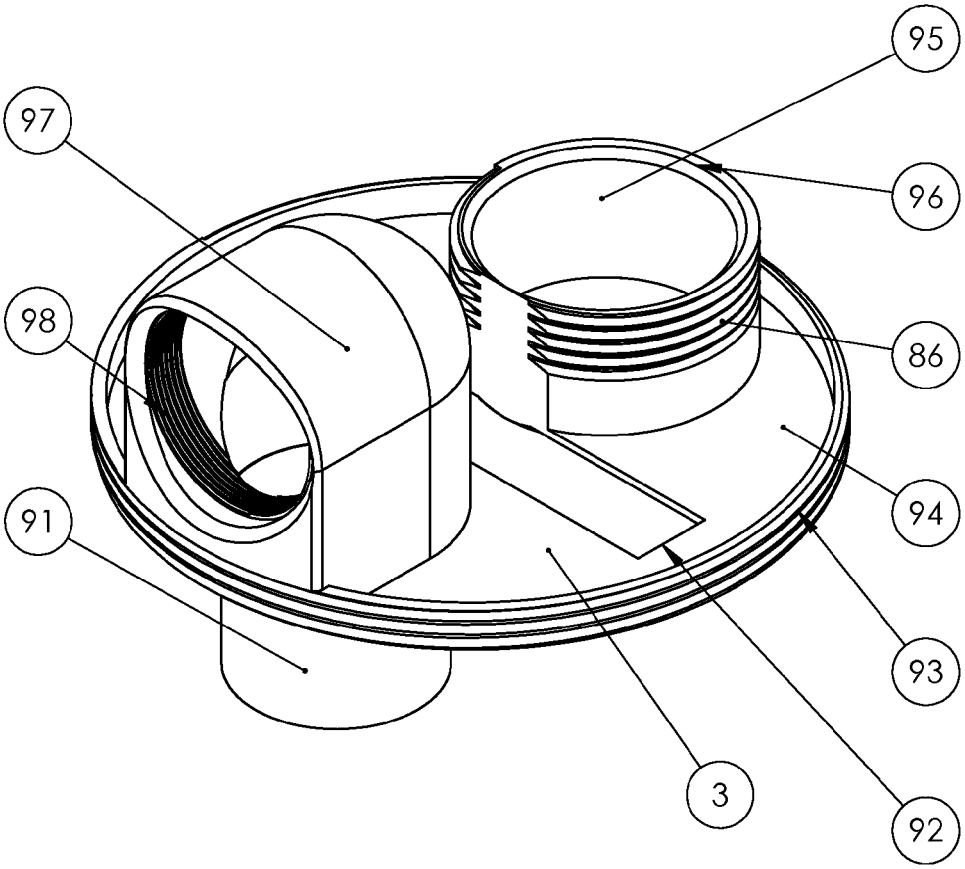
Fig. 9. Isometric view of connector top.

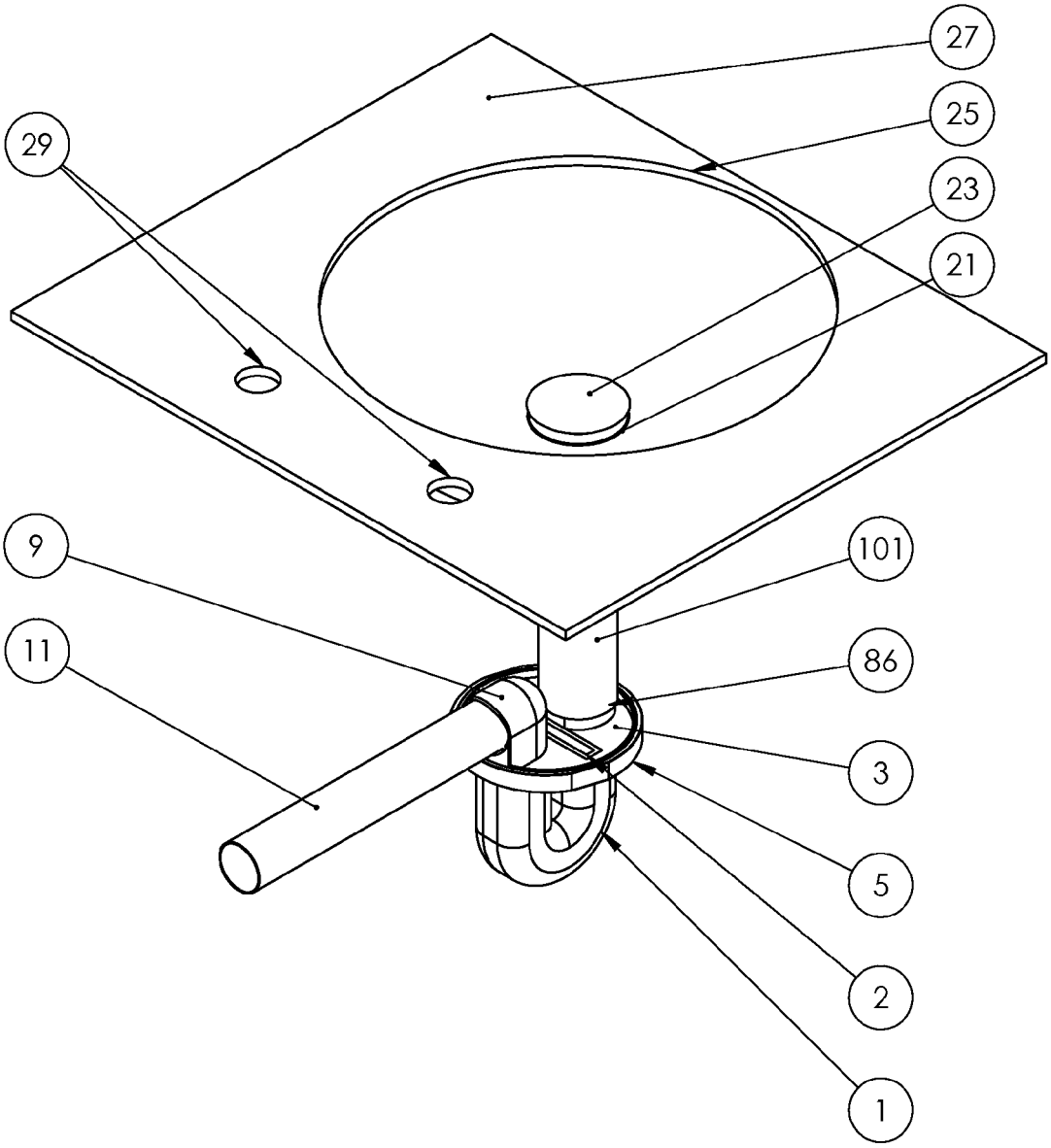
Fig. 10. Isometric view of removable trap system showing securing nuts.

REMOVABLE TRAP FOR LAVATORY SINKS

CROSS-REFERENCE TO RELATED APPLICATIONS

No cross reference is made to other applications.

STATEMENT REGARDING FEDERALLY SPONSORED RESEARCH OF DEVELOPMENT

No Federal Government support was received in the development of this Invention.

SEQUENCE LISTING, TABLE, OR COMPUTER PROGRAM LISTING

No sequence listing, table, or computer program is attached or accompanies this Application.

PATENTOR

Christopher Adam McLeod is the Sole Inventor of this Utility.

FIELD OF THE INVENTION

This Invention relates generally to trap fittings connected to lavatory sinks, and more particularly to traps fitted to lavatory sinks in infection control environments.

BACKGROUND OF THE INVENTION

Traps in plumbing are devices to contain sewer gas from rising from a municipal or septic tank sewage system up into a plumbed building via the drain hole on washing vessels. Usually gas ingress is halted by the trapping of a quantity of water between a vessel drain and a sewage system, although rubber seal hinged and sprung hatches are also used in less developed nations. Trap systems consist of the vessel they are connected to, as well as the drain fitting connecting a vessel fixture to a drainage pipe, as well as the sealing connecting assemblies that connect the drainage pipe to a trap fitting, and finally a waste arm leading to a vented vertical drainage pipe or "stack" connecting and draining many fixtures. The vessel of interest in this Application is called a lavatory or sink or even lavatory sink, all three names referring to a hand-washing sink. The lavatory sink is secured to a wall or counter and equipped with pressurized supply water fittings terminating in a faucet or faucets that supply water to the lavatory interior. The environment of interest in this Application is the infection control environment, for example, hospitals. The first line of infection management in infection control is the elimination, where possible, of uncleanable niches for microbes. Accordingly, internal overflow channels found in older household bathroom sinks are contraindicated for infection control environments, owing to restricted access for cleaning of the overflow channel. Consequently, overflow channels will not be addressed in this Application. The fixture fitting attached to the bottommost hole draining the vessel is called the drain or lavatory drain, and to the bottommost extremity of said drain is connected a tailpiece constructed of tubular metal or plastic and connecting to a downstream trap. In some installations accommodating wheelchairs under the lavatory, the tailpiece may be replaced by an elbow connected to a horizontal tube of metal or plastic connected eventually to a downstream trap. In either case, downstream of the trap is a horizontal waste arm comprised of tubular plastic or metal leading to the larger drainage system. Trap design has evolved greatly in order to achieve two objectives. The first objective is the containment of sewer gases over the service life of the trap. The second is to be cleanable. Current to the date of this Application, most traps in North America are required by building codes to be a tubular trap constructed of tubular plastic or metal bent into form and connected with various connection and sealing assemblies. Colloquially, a tubular trap assembly made of tubular metal or plastic connected to a lavatory is called a "P-trap" owing to its similarity in shape to the letter p in a horizontal position. The portion of the tube bent 180 degrees is referred to as the "J-bend" owing to one arm of this part being higher than the other. Critical in the J-bend is the air gap between the two upward tubular arms of the bended part, and the height of said gap. In contrast, a trap part comprising tube bend 180 degrees at the tube midpoint to form two upward arms of equal length would be called a "U-bend". Other manufacturing methods of the U-tube, such as casting, moulding, and forging may be preferable or necessary.

In this Invention called the removable trap for lavatory sinks, the traditional trap fitting system is modified to maintain said sewer gas control while enabling the provision of a removable tubular water trap portion for thorough cleaning or replacement. Easy removal of said trap portion has hitherto been impossible if the first functional objective of reliable sewer gas containment were to be maintained. The Invention described in this Application is able to meet both said objectives.

Through the provision of said objective of containing sewer gases and provision of said objective of cleanability through replaceability of the tubular trap part of the trap, the Invention described in this Application can be used as a tool to manage infectious microorganisms in an infection control environment. Lavatories are principally used for hand washing. Repeated use to wash hands, as well as the introduction of other biological refuse, can lead to build up of biofilm plaques containing infectious bacteria in the nutrient rich water trapped within the trap fitting. Biofilms are complex adhering structures produced by bacteria that enable differentiation in bacterial functionalities. Said bacteria can splash back up into the sink interior and be vectored onto human hands and other surrounding items, promoting infection where infection would not have occurred without the lavatory. This leads to the ironic situation in that the device, said lavatory, placed at great expense through the hospital to enable medical hygiene through hand-washing, poses the greatest risk of any hospital equipment. The Invention in this Application enables not only thorough cleaning, but elaboration of materials and processes centering around the tubular trap tube cartridge portion only, to concentrate expense on the retaining portion of the trap, said J-bend described earlier. Not only is the trap the origin of most infectious microorganism risk, it is also the portion of the trap system most vulnerable to attack by strong cleaning chemicals used in infection control environments such as hospitals. Rather than sacrificing anti-microbial properties of the trap material for the longevity perceived to be of importance in commercial buildings, the trap J-bend can be viewed as a replaceable item maximized for infection control. In practice, most hospital maintenance staff have anticipated this Invention by the awkward process of periodically replacing the entire trap assembly, a costly and time consuming exercise. The Invention described in this Application will provide an easier way to replace the most important, the most vulnerable, and the most powerful locus of infection management technologies. This strategy is common to medical hygiene, where disposable parts, for example the disposable plastic shroud on an electronic thermometer, are key in infection management. It is time this most Victorian of fittings, the lavatory trap, be adjusted to meet the expectations of modern infection control.

The history of modern trap starts largely with Thomas Crapper in England, who found that vectoring toilet waste with flush water into a tank pit equipped with an overflow prevented the ingress of sewer gas into the household. However, said pit traps posed a cleaning nightmare. Modern interpretations of Crapper's trap to the lavatory sink have generated a variety of patent applications, each illustrating important aspects of trap design. As a sample, Nunez (U.S. Pat. Appln. No. US 2004/0177439, Sep. 16, 2004) provides instead of a P-trap, an egg-shaped receptacle accepting the drainpiece from above and equipped with a waste arm to the side. If the bottom of said tailpiece is inserted such that its bottom end lies below the lowest point of the diameter of the exit port to the waste arm (commonly this lowest exit point downstream to the trap is called the "weir"), Nunez considered that this would be a sufficient barrier to trap gases as well as easy to clean. North American plumbing codes have all rejected this style of trap, called the "bottle trap" owing to its superficial resemblance to a beer bottle, for two reasons. One rejection reason is that siphonage can occur more easily without at least two inches of trap height to the weir. If water is siphoned out of the trap, this can lead to an empty trap, defeating its very purpose. More importantly, it is impossible to visually assess whether the tailpiece from the drain is below the weir by looking at the exterior of the trap. What happens often is that a long tailpiece extended even 2" below a weir will develop perforations above the weir. In this case, gases short circuit the trap, again defeating its very purpose. Bacon (U.S. Pat. Appln. No. US 2009/0308463, Dec. 17, 2009) presents another bottle trap that does indeed have an integral barrier inside to preserve the two inch to weir trap height that resists siphoning. However, there is no way to visually assess that that barrier is not perforated without disassembling it, and even then assessment of the integrity of the integral barrier would be difficult. Bottle traps have therefore been expressedly defined and banned in all building codes in Canada and the United States. Instead, the P-trap is preferred. If one or both walls bounding the gap in the J-bend fail, the trap will leak to the ground, an easy visual test. Further, the gap can be sized to preserve a 2" weir height on the inside of the J-bend to resist siphonage.

The trapping of sewer gases has been stated to be one objective of trap design. The other was cleanability. Ana (U.S. Pat. Appln. No. US 2006/0265804, Nov. 30, 2006) accepts the J-bend and attempts to add a cleanout consisting of a threaded plug and port. The novelty of Ana's application is that the cleanout port is horizontal, provided on the side of the J-bend to more easily accept a cleaning brush. Usually if a threaded clean-out port is provided, it is found on the lowest point of the J-bend. In either case, these tiny cleanout ports are unusable in infection control environments for a variety of reasons, including the unsuitability of any design of brush for cleaning tubes lined with biofilms, and more simply the leaking or corroding of said cleanouts. Beaumont (U.S. Pat. Appln. No. US/2014/0000019, Jan. 2, 2014) present an example of a brushless but high risk cleaning device consisting of a tube connected at the upstream end to water supply, and at the bottom end resting freely in the trap. Independent of its functionality, if the water supply pressure goes negative, as periodically happens, the trap water with its high risk of infectiousness would be directly sucked up into the fresh water supply, with potentially disastrous complications once supply water pressure returns. Any device not equipped with an air gap or other backflow prevention device is strictly illegal. This sort of direct flush can be designed in many ways, all of them strictly forbidden by building codes in Canada and the United States owing to said risk of cross-contamination of potable supply water with infections drainage water. The conclusion from a limited library of trap design applications is that the easiest and safest way to clean a trap is to design a trap that enables the easy and periodic removal of the water-containing 180 degree bend portion of the J-bend. Such a system is described in this application.

The removability of a trap enables other tools in fighting infection spread other than regular cleaning enabled by easy replaceability. These tools include enabling concentration of expense of material and methods into the portion of the trap most likely to support biofilm growth. Construction of the U-bend portion out of material that is inherently anti-microbial, for example certain copper alloys, or coated to be anti-microbial, is less expensive for hospitals when only the removable portion receives this special treatment. Processes such as heating can be incorporated just into the U-tube, and improvements made without discarding the entire trap assembly.

In conclusion, the U-tube portion of the lavatory trap system can be constructed of a plurality of plastics, metals, and other materials, using a plurality and possible combination of bending, soldering, welding, injection moulding, die-casting, forging, and other manufacturing methods. The ability to modify just the U-tube allows for easy cleaning, regular replacement, provision of purposeful materials, provision of purposeful technologies all to achieve antimicrobial ends and manage risk of infectiousness.

SUMMARY OF THE INVENTION

Accordingly, it is an objection of this invention to at least partially overcome some of the disadvantages of the prior art.

The Invention, a removable trap for lavatory sinks as described in this Application, is a drainage fitting for the drainage hole of a lavatory sink that includes a tubular portion bent 180 degrees to form a water trap distinguished by a complete gap between the two upward arms of this trap, said two upward arms terminating in a disc perforated to match the two upward tube openings, as well as perforated to maintain the gap between the two arms. The result is a "U-bend". The upper portion of the trap system comprises a connector top that not only secures and seals the downward portion of the drain tailpiece emanating from a plurality of lavatory sink drainage fittings, it provides for an anchoring connection between the drain fitting itself and the trap. The connector top provides a horizontal hub for the attachment of a horizontal waste arm. The gap between the two upward arms of the J-bend is preserved by a slot between these two hubs. The connector top is also equipped with a circumferential thread rim that allows a flanged nut to be introduced around the U-bend and draw the top disc of the U-bend against the connector top, sealing being effected by a complementary disc seal adorned with perforations and an orientating feature.

BRIEF DESCRIPTION OF THE DRAWINGS

In the drawings, which illustrate embodiments of the invention:

FIG. 1 shows an isometric view of the removable trap system attached to the underside of a lavatory sink fitting;

FIG. 2 shows an isometric view of a lavatory sink;

FIG. 3 shows an isometric view of a lavatory sink equipped with a lavatory drain fitting ending in a vertical tubular tailpiece;

FIG. 4 shows an isometric view of a lavatory sink showing vertical tailpiece and disconnected horizontal waste arm;

FIG. 5 shows an isometric view of removable trap system showing drain, tailpiece, waste arm, and tubular trap portion;

FIG. 6 shows an isometric view of the removable U-bend trap cartridge;

FIG. 7 shows an isometric view of removable trap system showing drain, tailpiece, waste arm, tubular trap, and seals;

FIG. 8 shows an isometric view of removable trap system showing drain, tailpiece, waste arm, trap, seals, and connecting top;

FIG. 9 shows an isometric view of connector top.

FIG. 10 shows an isometric view of removable trap system showing securing nuts.

DETAILED DESCRIPTION OF THE INVENTION

The Invention described in this Application is a novel drain fitting for a plurality of drained vessels known as lavatory sinks An isometric view of the entire removable trap system is shown in FIG. 1 as attached to a typical lavatory sink that might be secured to a wall or counter by a plurality of means. The removable U-bend trap portion 1 terminates in a disc feature which is captured by a flanged nut 5 to the threaded outer perimeter of a disc shaped connector top 3, said connector top accepting a horizontal tubular waste arm 11 into a hub mount 9. Although not part of this Invention, for reference the deck 27 of a lavatory sink is equipped with a bottommost drain hole 21, one of a plurality of drain protectors or closures 23, an overflow rim 25, and perforations 29 to mount supply taps.

An isometric view of the same lavatory drain prior to attachment of any fittings is shown in FIG. 2.

In FIG. 3, an isometric view of the same lavatory drain is shown equipped with one of a plurality of drain protector fittings or closure fittings 23 is shown affixed to the drain hole 21, and a tubular tailpiece 7 attached to the bottom of this fitting 23.

The isometric drawing in FIG. 4 shows the same lavatory sink 27, as well as a disconnected horizontal waste arm 11 that is as yet not connected to the tubular tailpiece 7 by means of a trap fitting connecting the bottommost end 43 of the tailpiece 7 to the upstream end 42 of the waste arm 11 whose downstream end 41 connects eventually to the vertical drainage stack.

FIG. 5 shows an isometric view of the same lavatory sink 27 to which is added the tubular U-bend portion 1, said U-bend being the first of the pieces of the connector assembly necessary to maintain a trap between the drain tailpiece 7 and the waste arm 11.

FIG. 6 shows an isometric view of the tubular U-bend portion 1 showing the opposing walls 61 and 63 of the U-bend that define a gap 62 between the two upward arms of the tube 64 bent 180 degrees. The two arms terminate and are attached to a horizontal disc 65 perforated by a hole 66 and another hole 67 that match the interior tube space to allow unobstructed flow. A slot 69 cut into said disc 65 continues the air gap between the two arms of the U-bend. Two ridged features 68 encircling the perforations ensure for a good seal to the underside of an overlying seal, preventing horizontal egress of water or gases.

FIG. 7 shows an isometric view of the same lavatory 27 with drain fitting 23 suspending a tailpiece 7. The tailpiece 7 will be sealed by sandwiching a drafted annular pipe seal 4. A disc shaped seal 2 with three perforations aligns with and fits into the U-bend top disc.

FIG. 8 shows an isometric view of the same lavatory 27 with drain fitting 23 suspending a tailpiece 7 further inserted into a U-bend removable trap cartridge composed of the U-bend 1, the seal 2, and the connector top 3. The tailpiece 7 is sealed using a drafted annular pipe seal 4 that fits into the upstream hub 86 which is externally threaded 4 for tightening. The downstream horizontal hub 9 allows for mounting of the horizontal waste tube by a plurality of attachment methods including thread mate.

FIG. 9 shows an isometric view of the connector top 3 with an upstream hub chamfered internally 96 to provide a good sealing surface, a threaded external perimeter 86 to allow for the capture and sandwich of a drafted annular seal to the sealing chamfer 96 by any one of a plurality of nuts. The flat surface 94 constitutes a strong flat surface to form the upper layer of a seal sandwich that is constituted by the upper side of the U-bend disc, a circular horizontal seal, and said disc surface 94. Said sandwiched seal assembly will be secured by a flanged nut that threads onto the threaded perimeter wall 93 of the connector top. Three perforations adorn the flat surface of the connector, one a downstream hub 97, one an upstream hub 95, and the third a slot gap 92 matching the slot gaps in the underlying U-bend upper surface and horizontal seal. This also allows for condensation dripping from above to drop to the floor. A vertical pipe stub 91 descends from the downstream hub of the top connector. Said stub 91 serves to protect the underlying planar seal from attack by cleaning chemicals, prevents rotation in the vertical axis of the components relative to one another, and helps to align the three pieces during reassembly.

FIG. 10 shows the isometric view of the same lavatory 27 to which the full trap sandwich is secured by two nuts. The perimeter flanged nut 5 captures and presses the top disc of the U-bend 1 to the underside of a disc-shaped horizontal seal, to further tighten against the connector top 3 by means of hand-tightening two flats 2. Another nut 101 consists of an internally threaded pipe nut that first is threaded up onto the external threads of the drain fitting, and then back down to tighten onto the externally threaded upstream hub on the upstream hub. This extended nut serves two functions. First, it adds to the robustness of the attachment of the top connector to the lavatory itself, and it also allows for predetermined spacing of the trap 1 and the lavatory 27. It has been demonstrated that this spacing is a critical factor in infection control.

The following Claims are made about the removable trap Invention described in this Application for use in providing a cleanable trap for lavatory drains:

1. A removable trap fitting comprising:

an assembly of three components sandwiched together by a circumferential flanged nut, the lowermost component being an upper terminal planar flange attached to a U-bend of tube or tube-shaped structure, the middle a horizontal planar seal and the upper a top planar connector adorned with two hubs, an upstream hub connecting to a tailpiece emanating from the bottom of the drain fitting attached to the lavatory drain hole, and a downstream hub accepting a waste arm leading eventually to a drainage system.

2. A removable trap fitting as claimed in claim 1 wherein the top connector is secured to the external thread of the drain fitting attached to the lavatory drain hole.

3. A removable trap fitting as claimed in claim 1 wherein a continuous air gap is maintained between all three pieces of the trap assembly to provide visual evidence of the intactness of the trap weir against upstream transmission of sewer gas.

* * * * *